US008210932B2

(12) United States Patent
Shiraishi

(10) Patent No.: US 8,210,932 B2
(45) Date of Patent: Jul. 3, 2012

(54) GAMING SYSTEM WITH A FREE GAME MODE

(75) Inventor: Kazutaka Shiraishi, Las Vegas, NV (US)

(73) Assignee: Konami Gaming, Incorporated, Las Vegas, NV (US)

( * ) Notice: Subject to any disclaimer, the term of this patent is extended or adjusted under 35 U.S.C. 154(b) by 155 days.

(21) Appl. No.: 12/766,672

(22) Filed: Apr. 23, 2010

(65) Prior Publication Data

US 2011/0263311 A1 Oct. 27, 2011

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

2003/0083943 A1 5/2003 Adams et al.
2006/0068903 A1 * 3/2006 Walker et al. ..... 463/25
2006/0183530 A1 8/2006 Ellis
2007/0060241 A1 * 3/2007 Low et al. ..... 463/13
2007/0275777 A1 11/2007 Walker et al.
2009/0291736 A1 11/2009 Walker et al.

OTHER PUBLICATIONS

International Search Report mailed Jul. 13, 2011 for the corresponding PCT application No. PCT/US2011/024987.

* cited by examiner

*Primary Examiner* — Corbett B Coburn
(74) *Attorney, Agent, or Firm* — Leason Ellis LLP

(57) ABSTRACT

A gaming system starts a free game mode when a predetermined condition is established in a game wherein the game is repeatedly executed a predetermined number of times without consuming a playing value, and gives a dividend to a player based on a result in the free game mode. The gaming system comprises a collective dividend lottery unit which determines a collective dividend in exchange for the game executed a specific number of times, a selection unit which selects any one of (a) reception of the collective dividend and (b) continuation of the game in the free game mode in response to the player's instruction, a collective dividend giving unit which gives the collective dividend to the player, and a remaining number of times control unit which decreases the remaining number of times of the game in the free game mode in exchange for giving the collective dividend.

11 Claims, 7 Drawing Sheets

Fig.5

| DIVIDEND MAGNIFICATION | WEIGHT | PROBABILITY | ACTUAL RATIO |
|---|---|---|---|
| 0.1 | 10 | 10% | 0.010 |
| 0.5 | 22 | 22% | 0.110 |
| 1.0 | 52 | 52% | 0.520 |
| 2.0 | 12 | 12% | 0.240 |
| 3.0 | 4 | 4% | 0.120 |
| TOTAL | 100 | 100% | 1.000 |

Fig.6

| | | |
|---|---|---|
| 0.1 | 000–009 | 10 numbers |
| 0.5 | 010–031 | 22 numbers |
| 1.0 | 032–083 | 52 numbers |
| 2.0 | 084–095 | 12 numbers |
| 3.0 | 096–099 | 4 numbers |

GAMING SYSTEM WITH A FREE GAME MODE

BACKGROUND OF THE INVENTION

1. Field of the Invention

The present invention relates to a gaming system that can provide a player with a free game mode in which a game is repeatedly executed a predetermined number of times without consuming a playing value.

2. Description of the Related Art

As one example of a gaming system configured to execute a predetermined game in exchange for consumption of a playing value and give a dividend to a player according to a result of the game, there is known a gaming machine such as a slot machine which starts, when a predetermined condition is established in the game, a free game mode in which the game is repeatedly executed a plural number of times without consuming a playing value as a bonus of the establishment of the condition (refer to, for example, Patent Documents 1 to 3). Note that the playing value is a concept symbolizing a right for playing the game. When the gaming machine is operated in a commercial application, the playing value is given to the player in exchange for a currency or given to the player in exchange for a pseudo coin such as a medal or a token that is exchanged for a currency, an electronic virtual currency, a point and the like. The playing value is quantitatively expressed using a term of a credit and other term. For example, a minimum unit of the playing value for playing a game once may be expressed as one credit.

Patent Document 1:US2009/0291736A1
Patent Document 2:US2007/0275777A1
Patent Document 3:US2006/0183530A1

SUMMARY OF THE INVENTION

When a free game mode is started once, since a considerable time is required until a game is executed a predetermined number of times and finished, a player may not leave from a gaming machine during the time the game is executed. Even if the player admits to finish the game while the free game mode continues, a feeling of satisfaction of the player to a dividend is lowered unless a dividend, which is expected to be obtained in the game that is not executed, is not properly processed. As a result, there is a possibility that an interest to the game is lost thereby.

Accordingly, an object of the invention is to provide a gaming system capable of finishing a free game mode at an early timing based on the intention of a player as well as properly processing a dividend, which is expected to be obtained in the free game mode, without sacrificing a feeling of satisfaction of the player.

In the invention, there is provided a gaming system that starts, when a predetermined condition is established in a game, a free game mode in which the game is repeatedly executed a predetermined number of times without consuming a playing value, and gives a dividend to a player based on a result of the game in the free game mode, comprising a collective dividend lottery unit which determines a collective dividend to be collectively given to the player by lottery in exchange for the game executed a specific number of times that is less than the remaining number of times of the game in the free game mode from a dividend range that can be obtained by increasing and decreasing the total amount of the dividend that is anticipated when the game is executed the specific number of times, a selection unit which selects any one of reception of the collective dividend and continuation of the game in the free game mode in response to an instruction from the player, a collective dividend giving unit which gives, when the reception of the collective dividend is selected, the collective dividend determined by the collective dividend lottery unit to the player, and a remaining number of times control unit which decreases the remaining number of times of the game in the free game mode according to the specific number of times in exchange for giving of the collective dividend.

According to the invention, when the player instructs the reception of the collective dividend, the collective dividend is determined by lottery from the dividend range that is obtained by increasing and decreasing the total amount of the dividends that are anticipated when the game of the free game mode is repeatedly executed the specific number of times, the determined collective dividend is given to the player, and the remaining number of times of the game in the free game mode is subtracted according to the specific number of times in exchange for the collective dividend. Accordingly, the free game mode can be finished at an early timing by receiving the collective dividend in exchange for execution of the game the specific number of times equal to or less than the remaining number of times. Moreover, since the collective dividend is determined by lottery from the dividend range obtained by increasing and decreasing the total amount of anticipated dividends, there can be generated a possibility that a large dividend, which exceeds the expected value of the dividend when the game is executed the specific number of times, is collectively given. With this arrangement, an accidental factor of the game is added to a result of the lottery when the reception of the collective dividend is selected. Accordingly, motivation for selecting the reception of the collective dividend by the intention of the player in expectation of obtaining a large dividend in a short time can be given to the player, and even if the player fails in the lottery to thereby obtain only a small collective dividend, it is possible to reduce a possibility that the feeling of satisfaction of the player is sacrificed. Since it is anticipated to reduce a time necessary to the free game mode, an improvement of profitability of the gaming system can be expected from the viewpoint of an operator of the gaming system.

BRIEF DESCRIPTION OF THE DRAWINGS

FIG. 5 is a view showing the relation between the dividend magnifications and the probabilities of a bonus dividend to be given in a bonus chance;

FIG. 6 is a view showing a data structure of a dividend magnification table prepared according to the relation of FIG. 5;

DESCRIPTION OF THE PREFERRED EMBODIMENT

Figure 1:
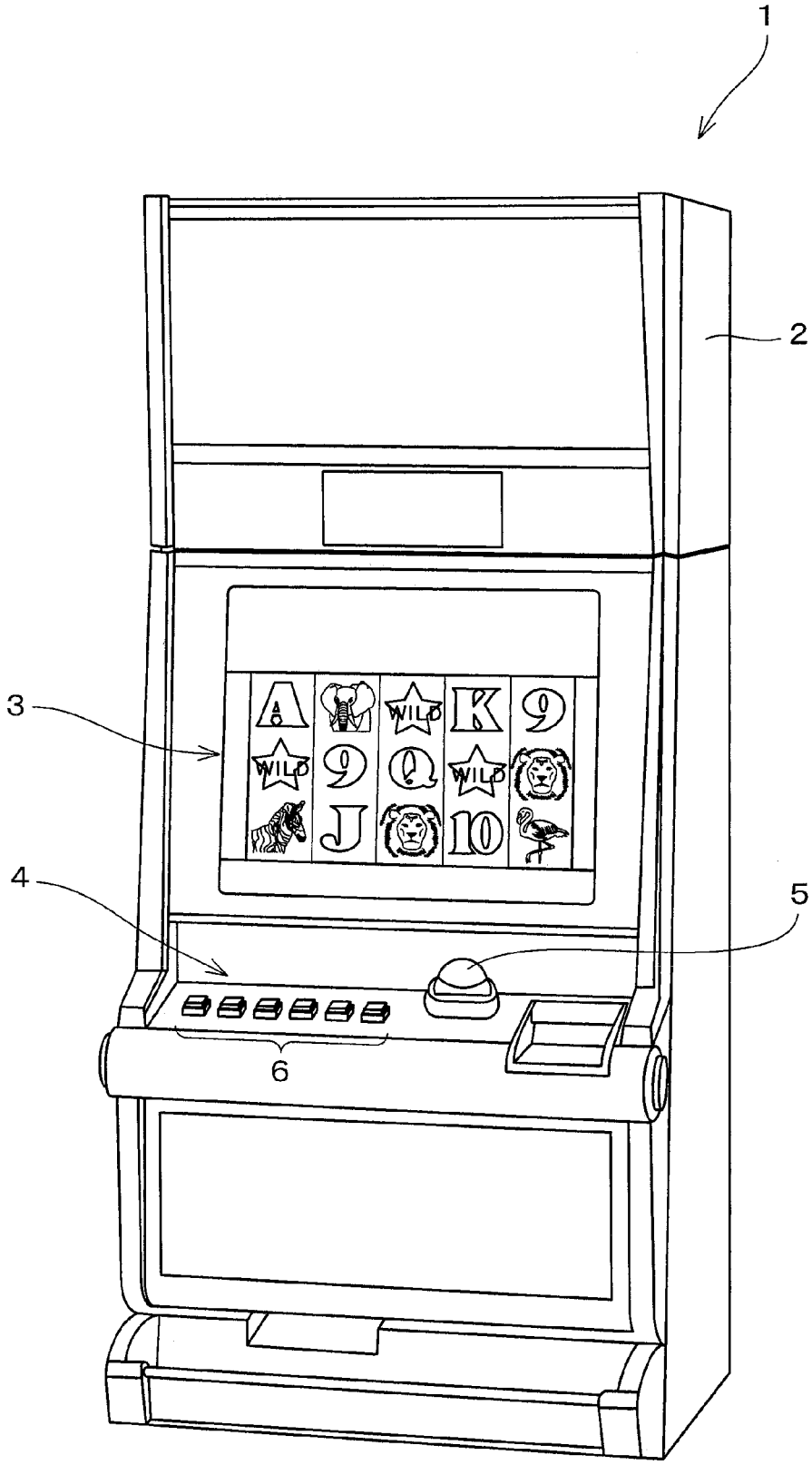
FIG. 1 is a perspective of a gaming machine as a gaming system according to an embodiment of the invention.

An embodiment, in which a gaming system according to the invention is configured as a slot machine type gaming machine, will be explained below referring to the drawings. As shown in FIG. 1, the gaming machine 1 of the embodiment includes an upright cabinet 2, and a display unit 3 is disposed on a front surface of the cabinet 2. As one example, the display unit 3 is a liquid crystal display unit. A control panel 4 is disposed below the display unit 3. A slot 5 and an operation unit 6 are disposed on the control panel 4. The operation unit 6 includes operation members such as button switches for executing, for example, abet operation and other various operations. Further, a touch panel input unit is disposed on a screen of the display unit 3 as apart of the operation unit 6.

Figure 2:
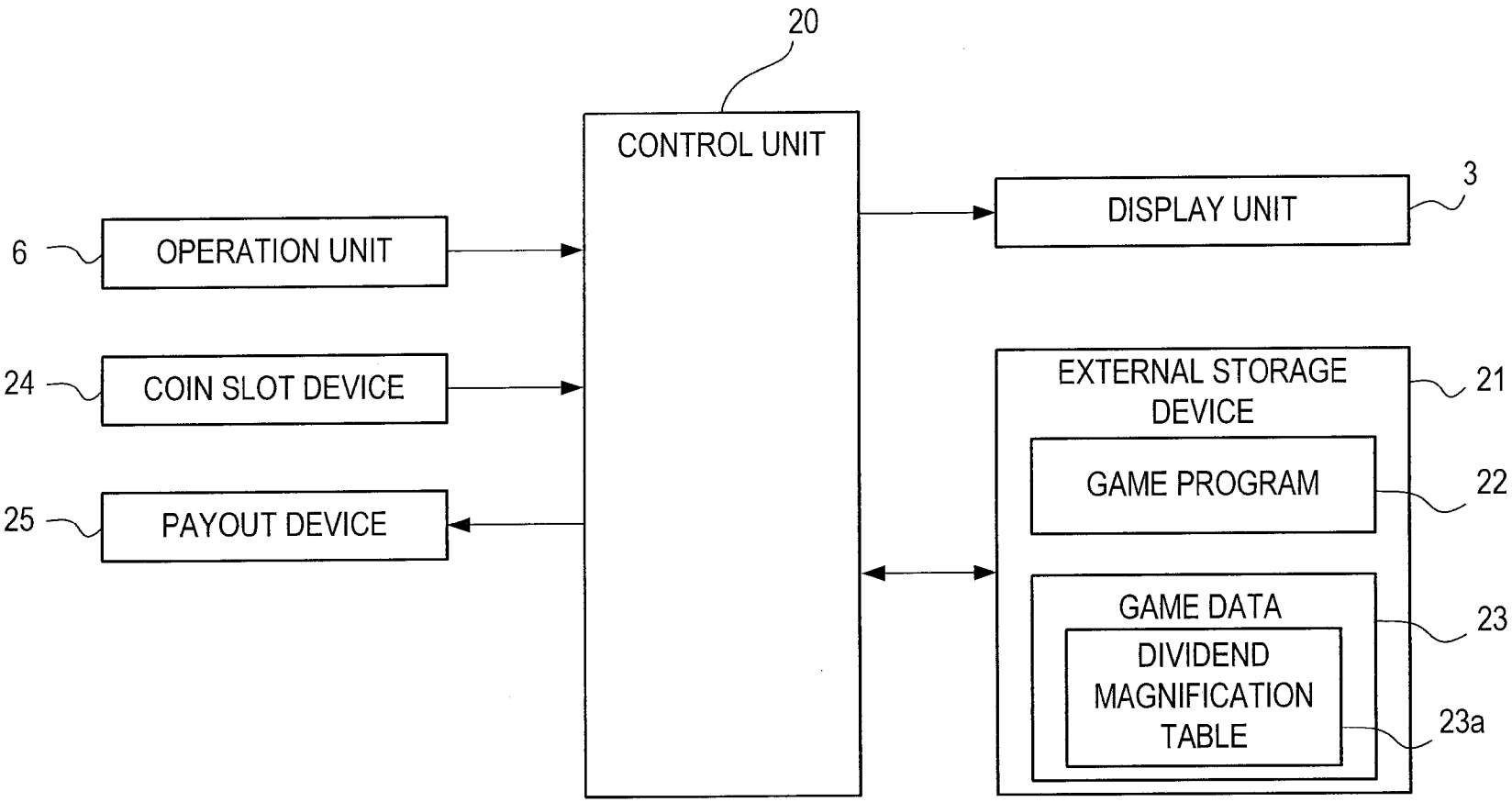
FIG. 2 is a block diagram showing a schematic configuration of a control system of the gaming machine.

FIG. 2 shows a schematic configuration of a control system of the gaming machine 1. The gaming machine 1 is provided with a control unit 20. The control unit 20 is configured as a computer unit including a microprocessor and peripheral devices such as a main storage device and the like necessary to operate the microprocessor. An external storage device 21 is connected to the control unit 20. The external storage device 21 includes a non-volatile storage medium such as a magnetic storage medium, a DVD-ROM, and an EEPROM, and a game program 22 and game data 23, which are necessary for the control unit 20 to control a game according to a predetermined procedure, are stored in the storage medium. The game program 22 is appropriately read to and executed by the control unit 20. The game data 23 is also appropriately read to and referred to by the control unit 20. The game data 23 includes a dividend magnification table 23*a*. The dividend magnification table 23*a* has a data structure as exemplified in FIG. 6. The dividend magnification table 23*a* will be described later in detail.

The operation device 6 and the display device 3 described above are connected to the control unit 20. The operation device 6 outputs a signal according to an operation of a player to the control unit 20. The display device 3 displays an image according to an image signal output from the control unit 20. The control unit 20 executes the game in the predetermined procedure according to the game program 22 referring to output signals of the operation device 6 and displays game screens according to the progress state of the game on the display device 3. Further, a coin slot device 24 and a payout device 25 are connected to the control unit 20 as an input device or an output device necessary to execute the game in addition to the operation device 6 and the display device 3 described above. The coin slot device 24 accepts insertion of a coin as a counter value for playing the game and outputs a signal according to the inserted amount of the coin (inserted money amount of the coin) to the control unit 20. The control unit 20 detects the amount of the currency inserted into the gaming machine 1 based on a signal of the coin slot device 24 and generates a number of credits according to the detected amount. The credit is a term for quantitatively expressing a playing value. In the following description, the minimum unit of the playing value for playing the game once may be called one credit. The payout device 25 pays a coin to the player as a dividend of the game in response to an instruction from the control unit 20. Note that payment of the counter value for playing the game and giving of the dividend to the player are not limited to the example using the coin. A medal, a token, and the like as an alternate currency may be used, and a settlement method capable of delivering the playing value through exchange of an electronic currency and other electronic information may be used.

Figure 3:
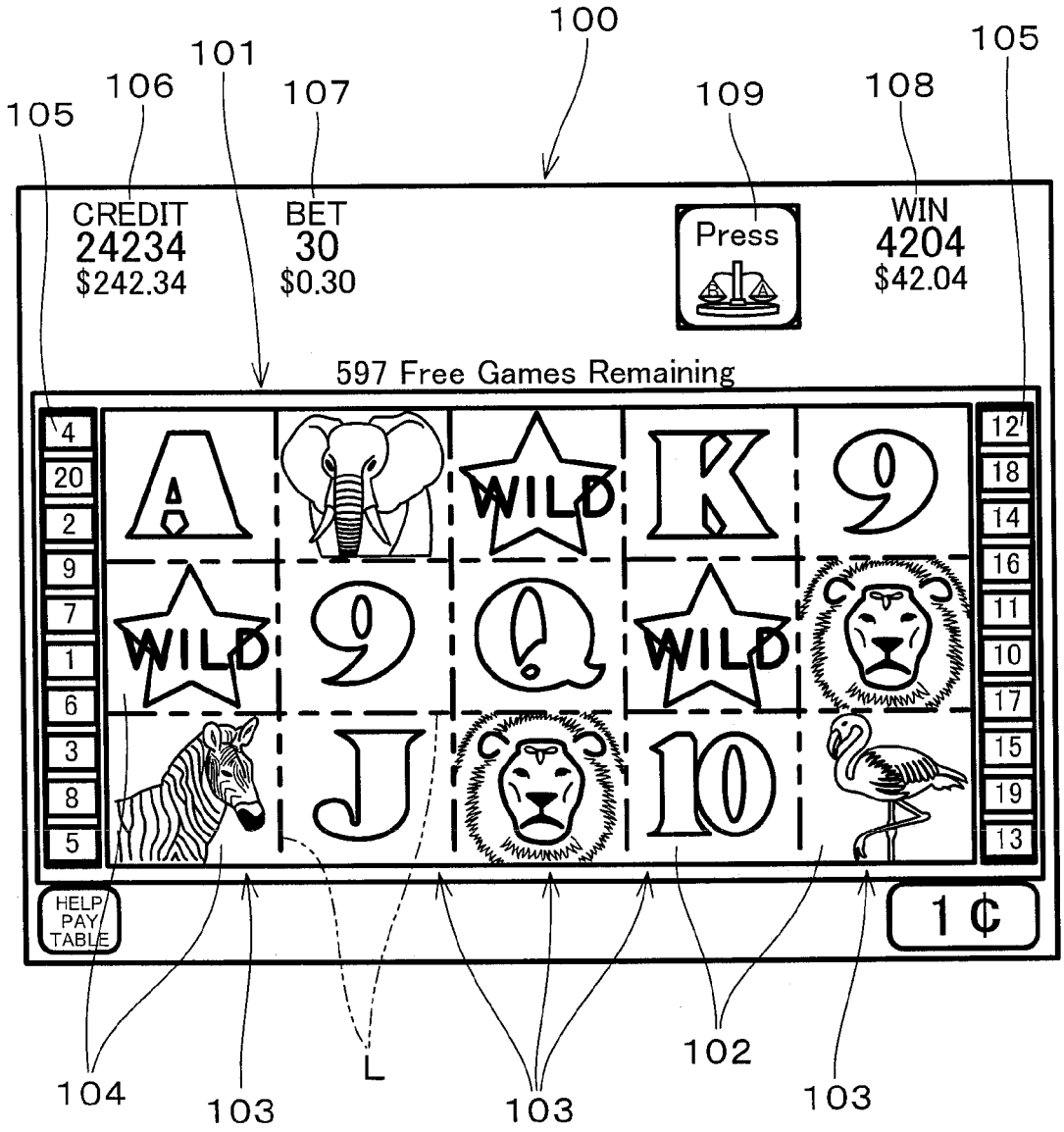
FIG. 3 is a view showing an example of a game screen displayed in a slot game.

Next, an outline of the game executed in the gaming machine 1 will be explained referring to FIGS. 3 and 4. As described above, the gaming machine 1 is configured as a slot machine. As known well, in the slot machine, when a combination of plural symbols forms a predetermined prize pattern, a dividend is given to the player. FIG. 3 shows an example of a game screen displayed on the display device 3 in a slot game. In the game screen 100, there is provided a lottery region 101 in which cells 102 having three rows in a longitudinal direction and five columns in a lateral direction arranged in a matrix state are prescribed as shown by imaginary lines L. Five reels 103 are displayed along the longitudinal columns (called a cell column) of the cells 102 in the lottery region 101 so as to be in parallel with each other. The reels 103 are video reels (virtual reels) expressed by an image. Plural symbols 104 are arranged to the respective reels 103 in the cell column direction at the same pitch as the pitch at which the cells 102 are arranged. With this configuration, each of the reels 103 serves as a symbol column. Line instruction portions 105 are disposed on both the sides of the lottery region 101 to display prize determination lines. In an upper portion of the game screen 101, there are provided a number of credits display portion 106 for showing the number of credits held by the player, a number of bets display portion 107 for showing the number of bets that is the number of credits betted by the player, and a dividend display portion 108 showing the number of dividends (shown by the same unit as that of the credits) obtained by the player. Further, a selection button 109 is also displayed on the game screen 100. When a predetermined condition is satisfied in a free game to be described later, the selection button 109 is placed in an operable state (active state), whereas when the predetermined condition is not satisfied, the selection button 109 is placed in an inoperable state (non-active state). The display mode of the selection button 109 changes depending on whether or not the selection button 109 is placed in the active state.

When the player designates a prize determination target line by operating the operation device 6 in exchange for consumption of a credit as the playing value and subsequently instructs to start the game, each of the reels 103 is scrolled in the cell column direction. Thereafter, when a predetermined stop timing comes, each of the reels 103 stops so that one symbol 104 appears in one cell 102. When the symbols 104, which stop in the cells 102 on a prize determination line, form a predetermined prize pattern, a dividend according to the prize pattern is given to the player. The prize pattern is appropriately set. Typically, when five symbols 104 of the same type are arranged in a row direction (right-to-left direction), it is determined that a prize pattern is formed. In the following description, a game mode, in which the reels 103 are rotated and stopped in exchange for consumption of a credit and it is determined whether or not a combination of the stopped symbols 104 forms a prize pattern, is called an ordinary mode. Since a procedure of the game in the ordinary mode is the same as that of a conventional slot machine, more detailed explanation of the procedure is omitted.

In the game of the ordinary mode, when a combination of symbols 104 that stop on a prize determination line forms a predetermined bonus pattern, the game is switched to a free game mode. The bonus pattern may be appropriately set. In the free game mode, the game is repeatedly executed a plural number of times without consuming a credit, and a dividend according to a result of the game of each time is given to the player. Further, the game is automatically started each time without waiting for a game start instruction from the player. The game executed in the free game mode (hereinafter, the game may be called a free game) is the same as the slot game executed in the ordinary mode except that whether or not a credit is consumed. Accordingly, there is a possibility that the bonus pattern is formed again in the free game mode and the free game mode is generated again. The regeneration of the free game mode is called a retrigger. Note that, although the prize determination lines in the free game mode may be appropriately determined, all the prize determination lines may be set, as an example, to a so-called maximum bet state in which the number of bets is set to a maximum limit and all the prize determination lines are designated. The free game mode described above is already executed also in known slot machines, and the contents of the free game mode such as a free game mode generation condition and the number of times of the free game in the free game mode may be appropriately set according to known examples also in the gaming machine 1 of the embodiment.

Although the number of times of the free game executed in the free game mode may be appropriately determined according to probabilities and the like at which the bonus pattern, which serves as a trigger for generating the free game mode, is generated, a number of times, for example, well over 100 times may be set. Since an increase of the number of times of the free game increases a time necessary until the free game mode is finished, there is assumed a case in which the player wants to finish the game for certain reasons while the free game mode continues or at the time the free game mode is generated. In the case, if the player would only be allowed to abandon the free game of a remaining number of times, there is a possibility that an interest to the game may be lost because the player abandons a dividend which can be expected to be obtained by the free game of the remaining number of times. To cope with the above problem, the gaming machine 1 of the embodiment performs a predetermined lottery in exchange for finish of the free game mode and a dividend obtained by lottery is collectively given to the player so that the player can select whether the player continues the free game or collectively receives the dividend obtained by lottery as a bonus dividend. In the following description, the mode for giving the bonus dividend by performing the lottery in exchange for continuation of the free game may be called a bonus chance, and a chance for selecting continuation of the free game or selecting shift to the bonus chance may be called a balance chance. Note that the selection button 109 displayed on the game screen 100 is operated to allow the shift to the balance chance while the free game mode continues.

Figure 4:
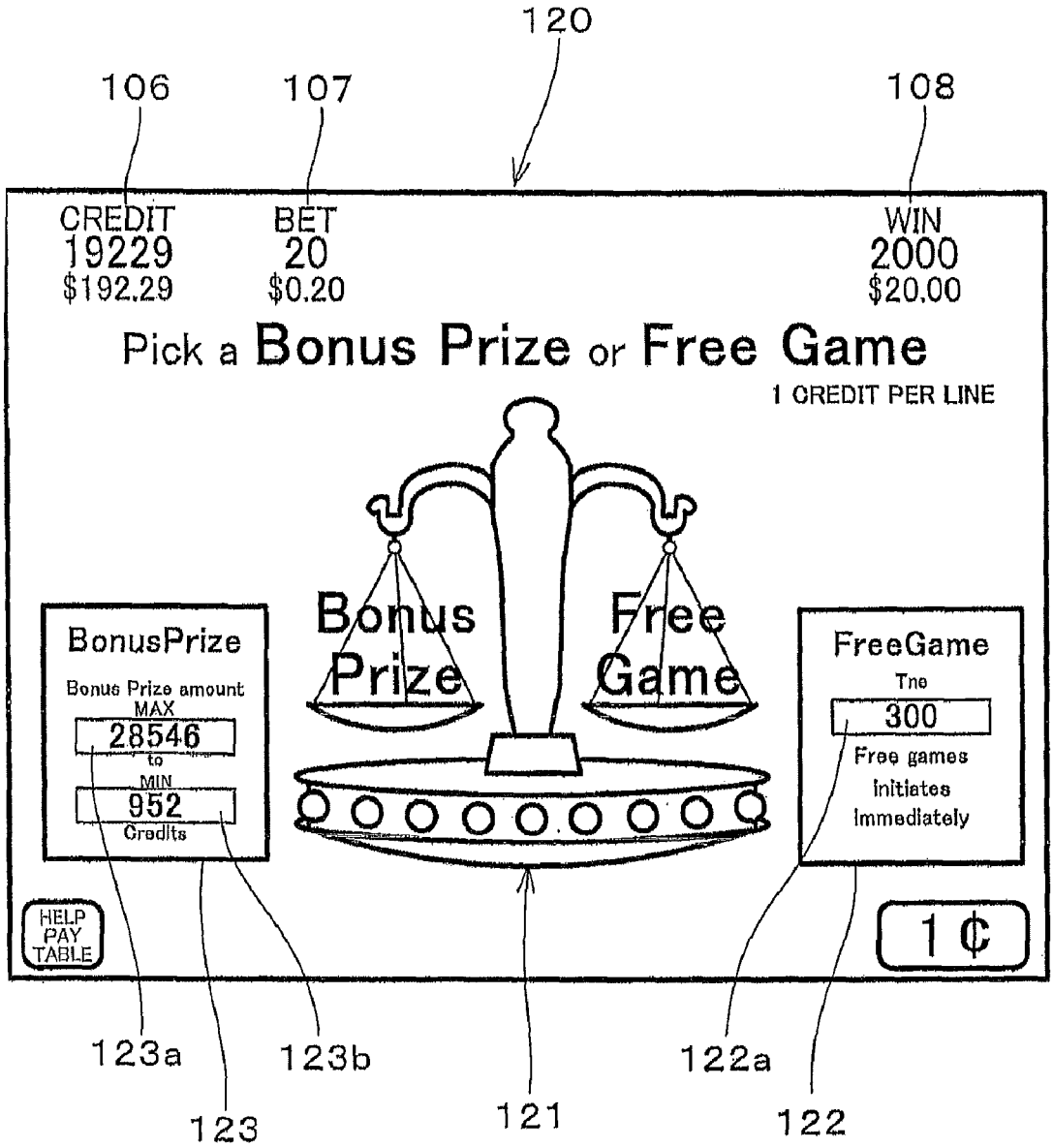
FIG. 4 is a view showing a selection screen displayed at the beginning and the like of a free game.

FIG. 4 shows an example of a game screen 120 at the time of the balance chance. The screen 120 of the balance chance is displayed when the free game mode starts and when the selection button 109 is operated in a state that the remaining number of times of the free game is equal to or more than 100 times. Likewise the game screen 100 of FIG. 3, in an upper portion of the game screen 120, there are displayed the number of credits display portion 106, the number of bets display portion 107, and the dividend display portion 108. An image 121 of a scale, which symbolizes the small and large of the dividend to be obtained by the free game and the bonus dividend, is displayed in a central portion of the game screen 120, and a free game selection portion 122 is provided on the right side of the image 121 and a bonus chance selection portion 123 is provided on the left side of the image 121, respectively. A remaining number of times display portion 122*a* is provided in the free game selection portion 122 to display a remaining number of times (in the illustrated example, 300 times) of the free game. In contrast, a maximum dividend display portion 123*a* and a minimum dividend display portion 123*b* are provided in the bonus chance selection portion 123, respectively, to display the maximum value (in the illustrated example, 28546) and the minimum value (in illustrated example, 952) of the bonus dividend which can be obtained when the bonus chance is selected in exchange for the free game to be executed the number of times displayed on the remaining number of times display portion 122*a*. The touch panel is disposed on the display device 3 as a part of the operation device 6, and when the player touches a display position of the free game selection portion 122, continuation of the free game is selected, whereas when the player touches a display position of the bonus chance selection portion 123, the bonus chance is selected. That is, the display of the game screen 120 allows the player to select continuation of the free game or shift to the bonus chance by comparing the remaining number of times of the free game with the range of the dividend that is expected if the player selects the bonus chance.

Next, the relation between the remaining number of times of the free game and the bonus dividend to be given in the bonus chance will be explained referring to FIGS. 5 and 6. First, the amount of the bonus dividend is calculated by Expression (1).

[Expression 1]

$$\text{bonus dividend} = \text{anticipated value of remaining number of times of game} \times \text{expected value of dividend of one game} \times \text{dividend magnification} \quad (1)$$

The anticipated value of the remaining number of times of the game is an average value of the remaining numbers of times corresponding to the remaining number of times displayed on the remaining number of times display portion 122*a*. As described above, in the free game mode, since the slot game is repeated likewise the slot game of the ordinary mode, the bonus pattern may be formed while the free game is repeated and the remaining number of times of the free game may be increased thereby. The increased number of the remaining number of times can be determined from the probabilities at which the bonus pattern is formed. The anticipated value of the remaining number of times of the game can be determined by adding an average value of the increased number of the remaining number of times to the remaining number of times. It is assumed that when the free game is repeated, for example, 100 times, the number of times of the game increases five times in average. In the assumption, when the remaining number of times of the free game is 150 times, the anticipated value of the remaining number of times of the game is 157.5 times (150+5×150/100). Further, the expected value of the dividend of one game in Expression (1) is a sum of the products of a probability at which prize patterns are formed and dividends corresponding to the prize patterns and corresponds to the expected value of the dividend that can be obtained by the player in the game executed once. Accordingly, the total amount of dividends which are anticipated when the free game is repeated the remaining number of times can be obtained by determining the product of the anticipated value of the remaining number of times of the game and the expected value of the dividend of one game. In the following description, the total amount of the dividends is called a total dividend equivalent amount. The value of the bonus dividend is determined by multiplying the total dividend equivalent amount by the dividend magnification. The dividend magnification is determined by selecting one of plural candidates that are previously prepared by lottery according to a predetermined probability.

FIG. 5 shows an example of the relation between dividend magnifications and probabilities to be applied to Expression (1). In the example, there are prepared five types of dividend magnifications, that is, 0.1 time, 0.5 time, 1.0 time, 2.0 times, and 3.0 times as the candidates of the dividend magnifications. Weights are applied to the candidates of the respective dividend magnifications. A probability at which each of the dividend magnifications is selected by lottery is given by replacing the weight with a ratio of percentage. An actual ratio of each dividend magnification is determined by determining the product of the probability and the dividend magnification. When it is assumed that an average value of a collective dividend (bonus dividend) is 1, the actual ratios are ratios of the respective dividend magnifications occupied in the average value. The weights are set so that the total of the weights of the dividend magnifications becomes 100 and the total value of the actual ratios becomes 1. Therefore, when the dividend magnifications are selected by lottery according to the probabilities of FIG. 5, the average value of the bonus dividends becomes equal to the average value of the total amount of the dividends obtained by the free games. That is, when the total value of the actual ratios in FIG. 5 is 1, even if a structure, which gives the bonus dividend to the player in exchange for the free games, is introduced, the payout ratio of the gaming machine 1 does not change in comparison with the case in which the structure is not introduced. Moreover, there is a possibility that the bonus dividend larger than the total dividend equivalent amount is generated by selecting one of the dividend magnifications by lottery. With this arrangement, a speculation property can be appropriately increased when the bonus chance is selected. When the total dividend equivalent amount is given to the player in exchange for finish of the free game mode uniformly, the process becomes a simply settlement process in which the remaining number of times of the free games is replaced with the amount of the dividend corresponding to the number of times and the dividend is given collectively. From the viewpoint of the player, it is hard to find a reason for daringly selecting the bonus chance except a reduction of time. However, when one of the dividend magnifications is selected by lottery and the bonus dividend is determined by multiplying the selected dividend magnification by the total dividend equivalent amount, since the accidental factor of the game is added also to the small and large of the bonus dividend, it can be expected to obtain a large dividend in a short time. With this arrangement, motivation for positively selecting the bonus chance can be given to the player. From a viewpoint of an operator of the gaming machine 1, since an operation time in the free game mode in which the game is repeated without consuming the playing value (credit) relatively decrease due to an increase of chance for selecting the bonus chance, an improvement of profitability of the gaming machine 1 can be expected.

FIG. 6 shows a data structure of the magnification table 23*a* stored in the external storage device 21 of the gaming machine 1. The magnification table 23*a* is a table for selecting the candidates of the dividend magnifications shown in FIG. 5 by lottery according to the probabilities of the dividend magnifications. In the magnification table 23*a*, the dividend magnifications prepared as the candidates are caused to correspond to random numbers having a predetermined number of digits (in the illustrated example, 3 digits in a decimal system). The number of the random numbers to be allocated to each of the dividend magnifications is differentiated according to the probability of FIG. 5. That is, in the magnification table 23*a* corresponding to FIG. 5, 10 random numbers are allocated to the dividend magnification of 0.1 times, 22 random numbers are allocated to the dividend magnification of 0.5 time, 52 random numbers are allocated to the dividend magnification of 1.0 time, 12 random numbers are allocated to the dividend magnification of 2.0 times, and 4 random numbers are allocated to the dividend magnification of 3.0 times, respectively. Accordingly, one of the dividend magnifications can be selected by lottery according to the probabilities of FIG. 5 by selecting any integer from 000 to 099 at random by lottery and selecting the dividend magnification that is caused to correspond to the obtained random number. Note that the dividend magnifications and the weights of the dividend magnifications shown in FIG. 5 are only examples. Setting of the dividend magnifications and the weights may be appropriately changed.

Figure 7:
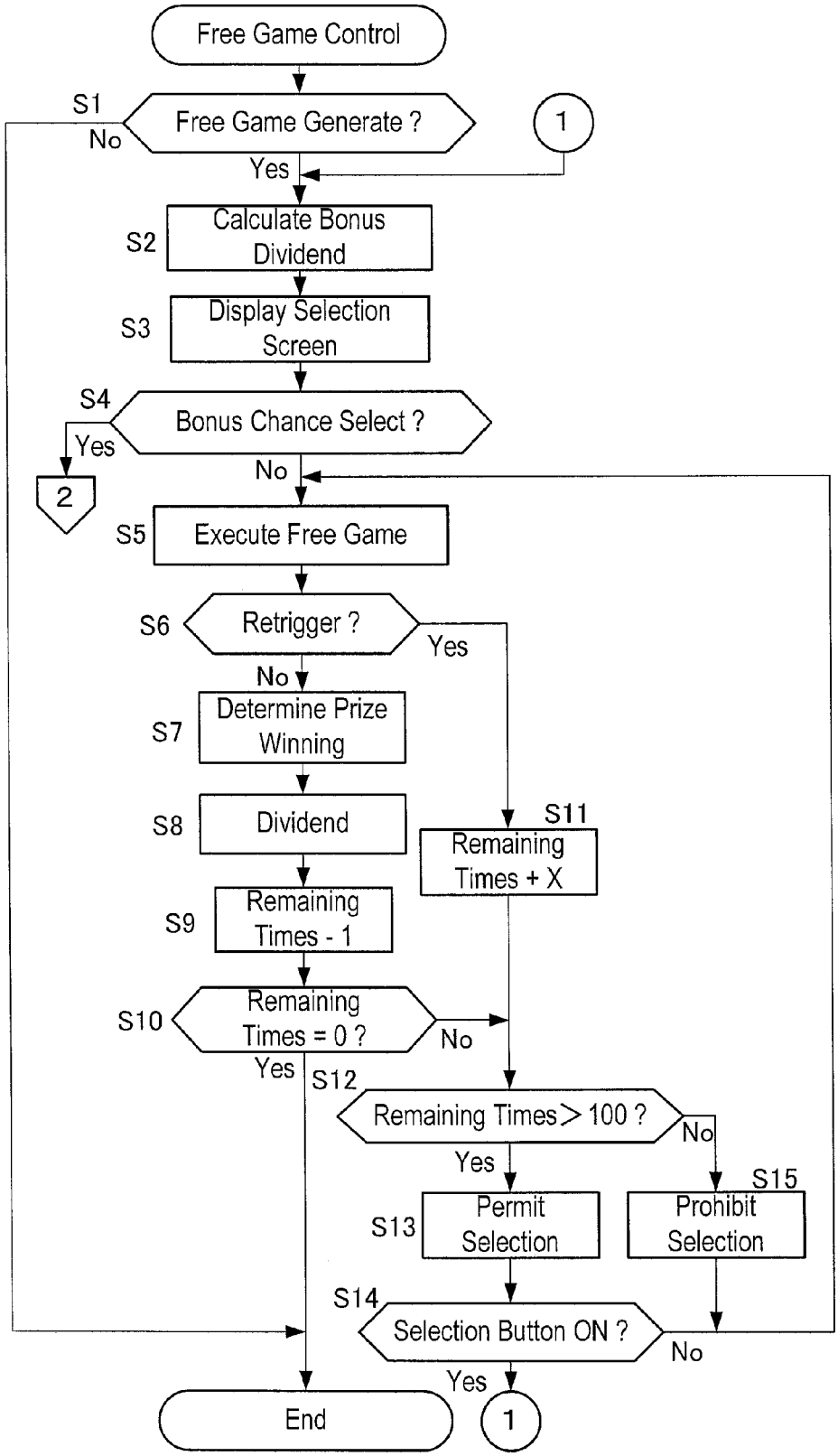
FIG. 7 is a flowchart showing a part of a free game control routine executed by a control unit.

FIG. 7 shows a free game control routine executed by the control unit 20 of the gaming machine 1 to control the free game described above. The routine is executed at the timing at which, for example, the reels 103 stop in the ordinary mode and a prize is determined. When the control unit 20 starts the routine of FIG. 7, the control unit 20 first determines whether or not a condition for generating the free game mode is satisfied at step S1 based on a combination of the symbols 104 that stop in the cells 102 on the prize determination line. When the condition for generating the free game mode is not satisfied, the control unit 20 finishes the routine, whereas when the condition for generating the free game mode is satisfied, the control unit 20 goes to step S2. At step S2, the control unit 20 calculates the maximum value and the minimum value of the bonus dividend when the bonus chance is selected making use of Expression (1) described above. That is, the anticipated value of the remaining number of times of the game of Expression (1) is determined according to the remaining number of times of the free game of this time as well as the bonus dividend is calculated by substituting each of the maximum magnification and the minimum magnification of the magnification table 23*a* for the dividend magnification of Expression (1). Note that it is sufficient to previously calculate the expected value of the dividend of one game of Expression (1) from the contents of the slot game presented by the gaming machine 1 and to store the expected value of the dividend in an internal storage device of the control unit 20, and it is not necessary to newly calculate the expected value of the dividend at step S2.

At subsequent step S3, the control unit 20 displays the game screen 120 as a selection screen shown in FIG. 4 on the display device 3. At the time, the maximum value and the minimum value of the bonus dividend calculated at step S2 are displayed on a maximum dividend display portion 123*a* and a minimum dividend display portion 123*b* of the bonus chance selection portion 123, respectively. However, any one of the maximum value and the minimum value may be displayed, and the display of the maximum value and the minimum value may be omitted. Thereafter, the control unit 20 goes to step S4 and determines whether or not the player selects the bonus chance referring to signals output from the touch panel of the operation device 6. That is, when the free game mode is generated, the player is given with a chance for selecting whether the player goes to a free game or shifts to the bonus chance before a first free game starts in the free game mode. When the bonus chance is not selected at step S4, that is, when it is determined that the player touches the free game selection portion 122, the control unit 20 goes to step S5, displays the game screen 100 of FIG. 3 on the display device 3, and executing the free game once. At the time, the credit is not consumed.

After executing the free game, the control unit 20 goes to step S6 and determines whether or not the bonus pattern is formed as a retrigger condition, that is, as a condition for generating the free game. When the control unit 20 determines that the retrigger is not generated, the control unit 20 goes to step S7 and determines whether or not the prize pattern is formed by the free game of this time. Thereafter, the control unit 20 goes to step S8 and gives the dividend to the player according to a result of the determination at step S7. When the prize pattern is not formed, the dividend is 0. Note that the dividend at step S8 may be notified to the player by being added to the number of the dividends of the dividend display portion 108 of the game screen 120 each time the free game of this time is finished. Otherwise, the dividends of respective times may not be notified to the player and may be stored in the control unit 20 until the free game mode is finished, and the cumulate value of the dividends may be added to the number displayed on the dividend display portion 108 at the time the free game mode is finished.

At subsequent step S9, the control unit 20 subtracts 1 from the remaining number of times of the free game and further determines whether or not the remaining number of times is 0 at next step S10. When the remaining number of times is 0 at step S10, the control unit 20 finishes the free game mode, whereas when the remaining number of times is not 0 at step S10, the control unit 20 goes to step S12. When it is determined at step S6 that the retrigger condition is satisfied, the control unit 20 adds a predetermined number X to the remaining number of times and goes to step S12. At step S12, the control unit 20 determines whether or not the remaining number of times of the free game exceeds 100 times. When the remaining number of times of the free game exceeds 100 times, the control unit 20 goes to step S13 and permits selection of the bonus chance. With this operation, the selection button 109 in the game screen 100 of FIG. 3 is switched to the active state. At subsequent step S14, the control unit 20 determines whether or not the selection button 109 is turned on, that is, whether or not the player touches the position of the selection button 109.

When the selection button 109 is not turned on at step S14, the process is returned to step S5. In contrast, when the selection button 109 is turned on, the process is returned to step S2. Accordingly, when the selection button 109 is turned on, the maximum value and the minimum value of the bonus dividend are calculated based on the remaining number of times at that time, the selection screen 120 is displayed, and the chance for selecting the bonus chance is given to the player. In contrast, when the player does not select the bonus chance, the free game is continued. Further, when the remaining number of times of the free game is equal to or less than 100 times at step S12, the control unit 20 goes to step S15 and prohibits selection of the bonus chance. At this time, the selection button 109 in the game screen 100 of FIG. 3 is switched to the non-active state. After selection of the bonus chance is prohibited, the control unit 20 returns to the process at step S5. Accordingly, although the bonus chance can be selected by turning on the selection button 109 after the free game mode is started once as long as the remaining number of times of the free game exceeds 100 times, when the remaining number of times becomes 100 times or less, the bonus chance cannot be selected. However, the retrigger condition is satisfied at step S6, there is a possibility that the bonus chance is selected again. A reason why the remaining number of 100 times of the free game is set as a threshold value and selection of the bonus chance is prohibited when the remaining number of times is equal to or less than 100 times is as described below. A certain time is necessary for the player to confirm the maximum value and the minimum value of the bonus dividend by turning on the selection button 109 and to determine whether or not the player shifts to the bonus chance. Accordingly, when selection of the bonus chance is admitted without restriction, since a time necessary until the free game mode is finished increases in comparison with a case in which the free game is simply repeated, the purpose of the bonus chance, which is introduced to reduce a time necessary to play the free game, cannot be achieved. To prevent such disadvantage, selection of the bonus chance is prohibited when the remaining number of times of the free game becomes the threshold value or less. However, the threshold value is not limited to 100 and can be appropriately changed.

Figure 8:
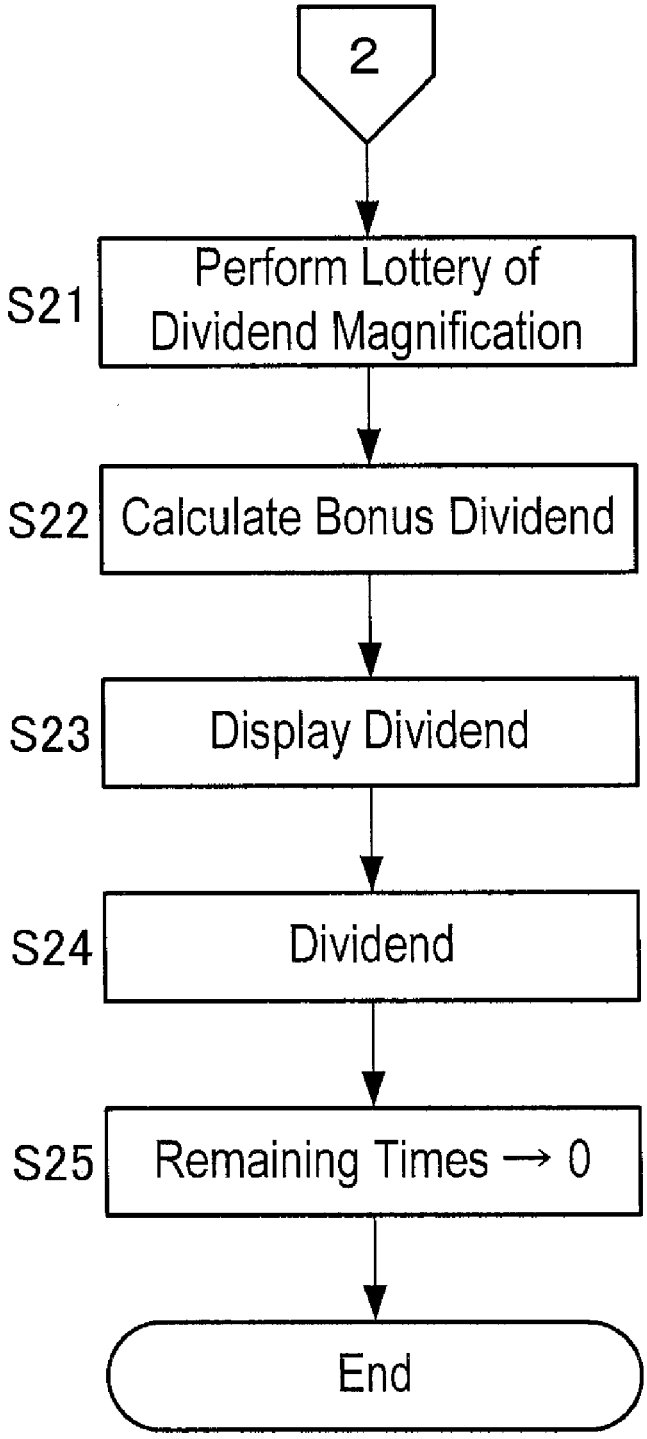
FIG. 8 is a flowchart succeeding to FIG. 7.

When the bonus chance is selected at step S4, the control unit 20 goes to step S21 of FIG. 8. At step S21, the control unit 20 selects one of the dividend magnifications in the bonus chance by lottery referring to the dividend magnification table 23*a*. That is, in the example of FIG. 6, any one integer is selected from 000 to 099 by lottery making use of the random numbers and the dividend magnification, which is caused to correspond to the selected value, is determined as the dividend magnification to be substituted for Expression (1). Subsequently, the control unit 20 goes to step S22 and calculates the bonus dividend in the bonus chance of this time by substituting the dividend magnification selected by lottery for Expression (1). At next step S23, the control unit 20 displays the determined bonus dividend to the player and thereafter adds the bonus dividend to the number of the dividends stored in the internal storage device at step S24 and displays the value after the bonus dividend is added to the number of the dividends of the dividend display portion 108. After the dividend is given to the player, the control unit 20 goes to step S25, resets the remaining number of times of the free game to 0, and finishes the routine of this time. With this operation, the remaining number of times of the free game is cancelled in exchange for the bonus dividend given to the player.

In the embodiment described above, the total dividend equivalent amount, which is calculated by the control unit 20 according to Expression (1) corresponds to the total amount of the dividend anticipated when the game is executed a specific number of times, and the range from the maximum value to the minimum value of the bonus dividend, which is obtained by multiplying the total dividend equivalent amount by candidates of the dividend magnifications corresponds to a dividend range. Further, the bonus dividend selected by lottery corresponds to a collective dividend which is collectively given to the player in exchange for the game of the specific number of times. The control unit 20 serves as a collective dividend lottery unit by executing processes (steps S21, S22) for calculating the bonus dividend by selecting any one dividend magnification from the candidates of the dividend magnifications by lottery and multiplying the obtained dividend magnification by the total dividend equivalent amount according to Expression (1). The control unit 20 serves as a selection unit by calculating the maximum value and the minimum value of the bonus dividend at step S2, displaying the selection screen 120 including the maximum value and the minimum value at step S3, and further determining whether or not the bonus chance is selected based on an instruction from the player at step S4. Further, the control unit 20 serves as a collective dividend giving unit by collectively giving the bonus dividend at step S24 and serves as a remaining number of times control unit by setting the remaining number of times to 0 at step S25.

The invention is not limited to the embodiment described above and may be carried out in various embodiments. For example, even though all the remaining number of times of the free game is collectively replaced with the bonus dividend in the bonus chance and given to the player in the embodiment, the number of times of the game, which is equal to or less than the remaining number of times of the game in the free game mode and is equal to or more than twice, may be set as a specific number of times, the player may be caused to select the bonus chance or continuation of the free game only to the specific number of times, and the bonus dividend corresponding to the specific number of times may be selected by lottery when the bonus chance is selected. In this case, it is sufficient to determine the anticipated value of the remaining number of times of the game of Expression (1) based on the specific number of times. Even if the specific number of times is set less than the remaining number of times, the time necessary in the free game mode can be reduced by selecting the dividend by lottery by replacing the free game of a plural number of times with one bonus chance. Note that when the specific number of times is less than the remaining number of times, the free game may be executed the number of times corresponding to the difference between the specific number of times and the remaining number of times or the bonus chance may be executed by setting at least a part of the difference as another specific number of times.

In the above embodiment, since the total of the weights of the table of FIG. 5 is set to 100 and the total of the actual ratios is set to 1, respectively, the probabilities of the dividend magnifications are adjusted so that the average value of the bonus dividends when the bonus chance is selected is equal to the average value of the total amount of the dividends when the free game is continued. However, the invention is not limited to the embodiment, and it may be adequate that a predetermined relation exists between the average of collective dividends and the average of the total amount of the dividends when the free game is continued. For example, in the above embodiment, the weights may be adjusted so that the total of the actual ratios has a value larger than 1 or a value less than 1. When the total of the actual ratios is larger than 1, since the average value of the bonus dividends when the bonus chance is selected becomes larger than the average value of the total amount of the dividends when the free game is continued, stronger motivation for selecting the bonus chance can be given to the player. In contrast, when the total of the actual ratios is less than 1, the average value of the bonus dividends when the bonus chance is selected becomes smaller than the average value of the total amount of the dividends when the free game is continued. However, since there is a possibility that the bonus dividend is given at a high magnification even in this case, it is possible to give motivation for selecting the bonus chance to the player.

Although the chance for selecting the bonus chance is provided when the free game mode starts in the above embodiment, it is not always necessary to guarantee such chance of the selection. For example, reception of a collective dividend (bonus dividend) can be selected under the condition that the game is repeated an appropriate number of times after the free game mode starts. Further, in the above embodiment, although it is made impossible to select reception of the collective dividend when the remaining number of times becomes less than a predetermined threshold value, the restriction may be omitted. Otherwise, a condition other than the remaining number of times of the game may be set as to whether or not the selection of the reception of the collective dividend is permitted. As to the selection between reception of a collective dividend and continuation of the game in the free game mode, the balance chance using the selection screen 120 is provided to thereby give the chance of selection in the above embodiment. However, it is not always necessary to give an intermediate chance of selection between both options. For example, the selection unit may be configured such that the game in the free game mode is continued when the selection button 109 is not operated even if the selection button 109 is active, whereas the state is transferred to the bonus chance when the selection button 109 is active and it is operated.

The invention is not limited to the slot machine and can be also applied to any gaming machine that presents a game having a free game mode in which the game is repeatedly executed a plural number of times without consuming a playing value and a dividend is given according to a result of the game for the purpose of finishing the free game mode at an early timing by giving a dividend by replacing at least a part of the game of the free game mode with a lottery performed once. At the time when the remaining number of times of the free game is 1, the selection between the bonus chance and the continuation of the free game may be allowed.

The invention is not limited to an example that is configured as a gaming machine of so-called stand alone type. The gaming system according to the invention may be configured as a network type gaming system in which a server and a gaming machine as a terminal device, which are connected to each other via a network, are combined to thereby allow a predetermined game to be executed.

The invention claimed is:

1. A gaming system that starts, when a predetermined condition is established in a game, a free game mode in which the game is repeatedly executed a predetermined number of times without consuming a playing value, and gives a dividend to a player based on a result of the game in the free game mode, comprising:

a collective dividend lottery unit which determines a collective dividend to be collectively given to the player by lottery in exchange for the game being executed a specific number of times that is less than the remaining number of times of the game in the free game mode from a dividend range that can be obtained by increasing and decreasing the total amount of the dividend that is anticipated when the game is executed the specific number of times;

a selection unit which selects any one of reception of the collective dividend and continuation of the game in the free game mode in response to an instruction from the player;

a collective dividend giving unit which gives to the player, when the reception of the collective dividend is selected, the collective dividend determined by the collective dividend lottery unit; and a remaining number of times control unit which decreases the remaining number of times of the game in the free game mode according to the specific number of times in exchange for giving of the collective dividend.

2. The gaming system according to claim 1, wherein the collective dividend lottery unit determines the collective dividend to be drawn by the lottery from the dividend range by drawing one dividend magnification from candidates of plural dividend magnifications to be multiplied by the anticipated total amount of the dividend by the lottery at a predetermined provability, and multiplying an obtained dividend magnification by the anticipated total amount of the dividend.

3. The gaming system according to claim 2, wherein the selection unit requires the player to select any one of the reception of the collective dividend and the continuation of the game in the free game mode in a state of presenting at least one of a maximum value of the collective dividend that is obtained by multiplying a maximum value in the candidates of the dividend magnifications by the anticipated total amount of the dividend and a minimum value of the collective dividend that is obtained by multiplying a minimum value in the candidates of the dividend magnifications by the anticipated total amount of the dividend to the player.

4. The gaming system according to claim 2, wherein the probability at which each of plural dividend magnifications is drawn by the lottery is set in such a manner that an average value of the collective dividend to be given by the collective dividend giving unit is equal to an average value of the total amount of the dividend to be given in a case where the game is continued the specific number of times.

5. The gaming system according to claim 1, configured to make the specific number of times accord with the remaining number of times.

6. The gaming system according to claim 5, wherein the predetermined condition can be established in the game in the free game mode, the remaining number of times increases if the predetermined condition is established in the free game mode, and the anticipated total amount of the dividend corresponds to a value obtained by multiplying an anticipated value of the remaining number of times in which an effect of increase of the remaining number of times is included by an expected value of the dividend of one game.

7. The gaming system according to claim 1, wherein a selection by the selection unit is allowed at a time of starting the free game mode.

8. The gaming system according to claim 1, wherein a selection by the selection unit is allowed after executing at least one game in the free game mode.

9. The gaming system according to claim 1, wherein the selection unit enables a selection of the reception of the collective dividend if the remaining number of times exceeds a predetermined threshold value, while enables only the continuation of the game in the free game mode if the remaining number of times is equal to or less than the threshold value.

10. The gaming system according to claim 1, configured to execute, as the game, a slot game in which plural symbol columns individually move and stop, and when a combination of plural symbols which stop on a predetermined prize determination line forms a predetermined prize pattern, the dividend according to a prize pattern is given.

11. A computer-assisted method for electronically starting a free game when a predetermined condition is established in a game, wherein said game is repeatedly executed a predetermined number of times without consuming a playing value, and for electronically giving a dividend to a player based on a result of the game in the free game mode, comprising the steps of:

determining a collective dividend to be collectively given to the player by lottery in exchange for the game being executed a specific number of times that is less than the remaining number of times of the game in the free game mode from a dividend range that can be obtained by increasing and decreasing the total amount of the dividend that is anticipated when the game is executed the specific number of times;

selecting any one of reception of the collective dividend and continuation of the game in the free game mode in response to an instruction from the player;

giving, when the reception of the collective dividend is selected, the collective dividend to the player; and decreasing the remaining number of times of the game in the free game mode according to the specific number of times in exchange for giving of the collective dividend.

* * * * *